US008465128B2

(12) United States Patent
Yamashita

(10) Patent No.: US 8,465,128 B2
(45) Date of Patent: Jun. 18, 2013

(54) LIQUID DISCHARGE APPARATUS AND IMAGE FORMING APPARATUS

(75) Inventor: Toru Yamashita, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 166 days.

(21) Appl. No.: 12/891,109

(22) Filed: Sep. 27, 2010

(65) Prior Publication Data

US 2011/0074848 A1 Mar. 31, 2011

(30) Foreign Application Priority Data

Sep. 30, 2009 (JP) ..... 2009-227889

(51) Int. Cl.
*B41J 2/14* (2006.01)
*B41J 2/045* (2006.01)

(52) U.S. Cl.
USPC ..... 347/50; 347/70

(58) Field of Classification Search
None
See application file for complete search history.

(56) References Cited

U.S. PATENT DOCUMENTS

| | | | | |
|---|---|---|---|---|
| 6,891,314 | B2 * | 5/2005 | Sato et al. | 310/328 |
| 7,117,597 | B2 * | 10/2006 | Nishida | 29/890.1 |
| 2006/0209141 | A1 | 9/2006 | Kojima | |

FOREIGN PATENT DOCUMENTS

| | | |
|---|---|---|
| JP | 2003-127366 | 5/2003 |
| JP | 2004-273765 | 9/2004 |
| JP | 2006-255948 | 9/2006 |
| JP | 2007-276158 | 10/2007 |
| JP | 2008-183880 | 8/2008 |
| JP | 2009-054785 | 3/2009 |
| JP | 2009-111283 | 5/2009 |

OTHER PUBLICATIONS

Notice of Reasons for Rejection for Japanese Application No. 2009-227889 dated Mar. 26, 2013.

* cited by examiner

*Primary Examiner* — Geoffrey Mruk
(74) *Attorney, Agent, or Firm* — Frommer Lawrence & Haug LLP

(57) ABSTRACT

A liquid discharge apparatus includes a liquid discharge head and a circuit board. The liquid jetting head includes a channel unit in which a plurality of nozzles and a plurality of liquid channels communicating with the nozzles respectively are formed, a plurality of drive portions which drive a plurality of deforming portions to deform so as to apply a jetting pressure to a liquid in the liquid channels, a plurality of lead portions arranged to cover the electrodes while maintaining a space between the electrodes and the lead portions, and a plurality of input terminals which are electrically connected to the electrodes via the lead portions. A plurality of connecting terminals which are electrically connected to the input terminals respectively are formed on the circuit board.

15 Claims, 13 Drawing Sheets

LIQUID DISCHARGE APPARATUS AND IMAGE FORMING APPARATUS

CROSS REFERENCE TO RELATED APPLICATION

The present application claims priority from Japanese Patent Application No. 2009-227889, filed on Sep. 30, 2009, the disclosure of which is incorporated herein by reference in its entirety.

BACKGROUND OF THE INVENTION

1. Field of the Invention

The present invention relates to a liquid discharge apparatus which includes a liquid jetting head having a drive portion which is deformed according to a drive signal and a circuit board which supplies the drive signal to the drive portion, and an image forming apparatus which includes the liquid discharge apparatus.

2. Description of the Related Art

As an example of a liquid discharge apparatus, an ink jet apparatus which is to be used in an ink-jet printer has hitherto been known. An ink jet apparatus described in Japanese Patent Application Laid-open No. 2009-111283 includes an ink-jet head having a plurality of nozzles and a plurality of drive portions which are deformed according to a driving pulse to apply a jetting pressure for jetting an ink from the nozzles, and a circuit board through which the driving pulse for driving the drive portions are supplied. The drive portions in the ink-jet head have electrodes, and input terminals through which the driving pulse is input are electrically connected the electrodes, respectively. Moreover, connecting terminals on the circuit board are connected electrically and physically to the input terminals.

SUMMARY OF THE INVENTION

In the abovementioned ink-jet apparatus, a 'unimorph structure' in which each of the drive portions is deformed toward both sides in a thickness direction thereof has been adopted, and it is necessary to make an arrangement such that the deformation of the drive portion including the electrode is not hindered, in order for jetting the ink stably from the nozzles. Therefore, in the abovementioned ink jet apparatus, the input terminals have been arranged, on the same surface as of the plurality of individual electrodes, at positions away from the drive portions. However, in this structure, since the input terminals have to be arranged on the surface on which the electrodes are to be formed, it has been difficult to arrange the plurality of electrodes highly densely.

On the other hand, a structure in which contact portions (input terminals) are arranged at an upper side of an electrode layer (in other words, electrodes) has been disclosed in Japanese Patent Application Laid-open No. 2009-54785. According to this structure, although a surface on which the electrode layer is to be formed is not narrowed by the presence of the contact portion, the contact portion makes a direct contact with the electrode layer and also wires make a direct contact with the contact portions. Therefore, there is a possibility that the deformation of the drive portions is hindered by the contact portions and the wires.

The present invention has been made to solve the abovementioned issues, and an object of the present invention is to provide a liquid discharge apparatus in which it is possible to prevent the deformation of the drive portion from being hindered by the circuit board etc., and also it is possible to arrange the plurality of electrodes highly densely, and an image forming apparatus in which the liquid discharge apparatus is used.

According to an aspect of the present invention, there is provided a liquid discharge apparatus which discharges a liquid, including a liquid discharge head including: a channel unit formed with a plurality of nozzles through which the liquid is discharged and a plurality of liquid channels which communicate with the nozzles respectively; a plurality of drive portions having a plurality of electrodes corresponding to the nozzles respectively; and a deforming portion which is deformed to apply a jetting pressure to the liquid stored in the liquid channels according to a driving pulse applied to the electrodes; a plurality of lead portions which are connected electrically to the electrodes and which are arranged to cover the electrodes while maintaining a space between the electrodes and the lead portions; and a plurality of input terminals each of which is formed integrally on a surface, of one of the lead portions, not facing the electrodes and which are electrically connected to the electrodes via the lead portions; and a circuit board via which the driving pulse is applied to the liquid discharge head, and which has a plurality of connecting terminals electrically connected to the input terminals, respectively.

In this structure, since the lead portions are arranged while maintaining the space between the electrodes and the lead portions, it is possible to prevent the lead portions, the input terminals, and the circuit board from making a contact with a central portion of the electrodes, and to inhibit the deformation of the drive portions from being hindered. For instance, when the lead portions are bridged between two locations of an edge portion or a peripheral portion of the electrode, while maintaining the space between the electrodes and the lead portions, and the input terminals are formed integrally with the lead portions, it is possible to arrange the input terminals at positions facing the electrodes, and it is possible to arrange the plurality of electrodes highly densely as compared to a case in which the electrodes and the input terminals are arranged on the same surface.

According to the present invention, since it is possible to inhibit the deformation of the drive portions from being hindered by the circuit board etc., it is possible to stabilize an operation of jetting of liquid by the drive portions. Moreover, since it is possible to arrange the electrodes highly densely, it is possible to arrange the plurality of nozzles highly densely, and to improve a jetting density of liquid.

BRIEF DESCRIPTION OF THE DRAWINGS

FIG. 10A is a cross-sectional view in a 'longitudinal direction' of an electrode, and FIG. 10B is a cross-sectional view in a 'short-axis direction' of the electrode;

DETAILED DESCRIPTION OF THE PREFERRED EMBODIMENTS

A 'liquid discharge apparatus' according to a first embodiment of the present teachings will be described below while referring to the accompanying diagrams.

Figure 1:
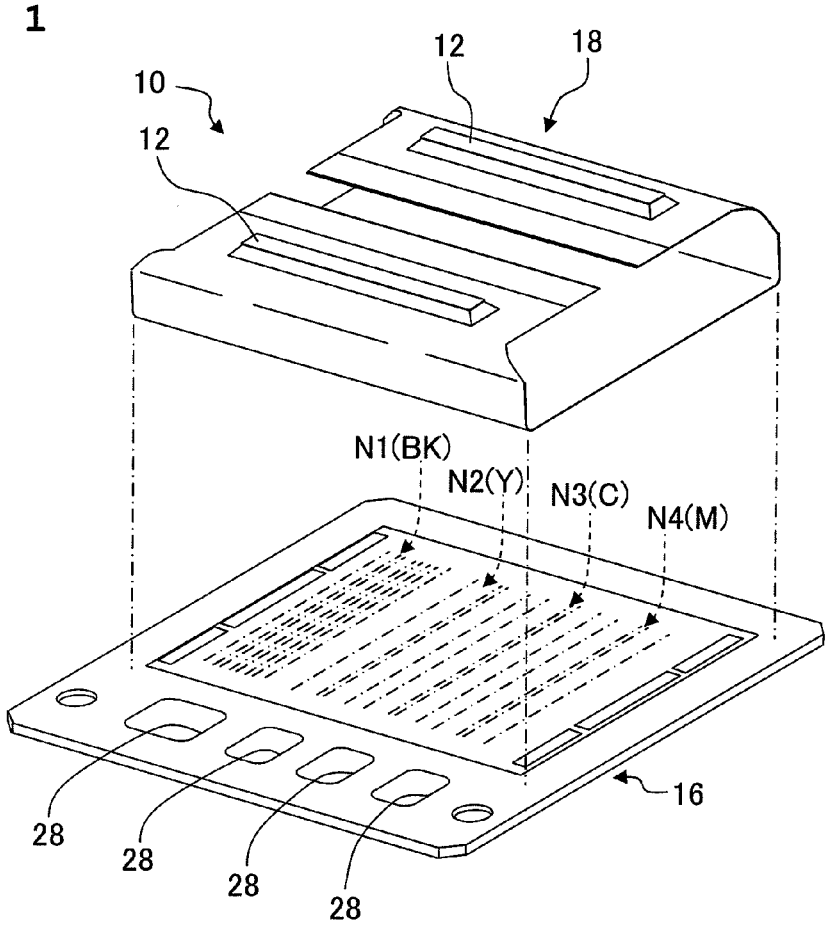
FIG. 1 is an exploded perspective view showing a structure of an 'ink-jet apparatus' according to a first embodiment.
Figure 15:
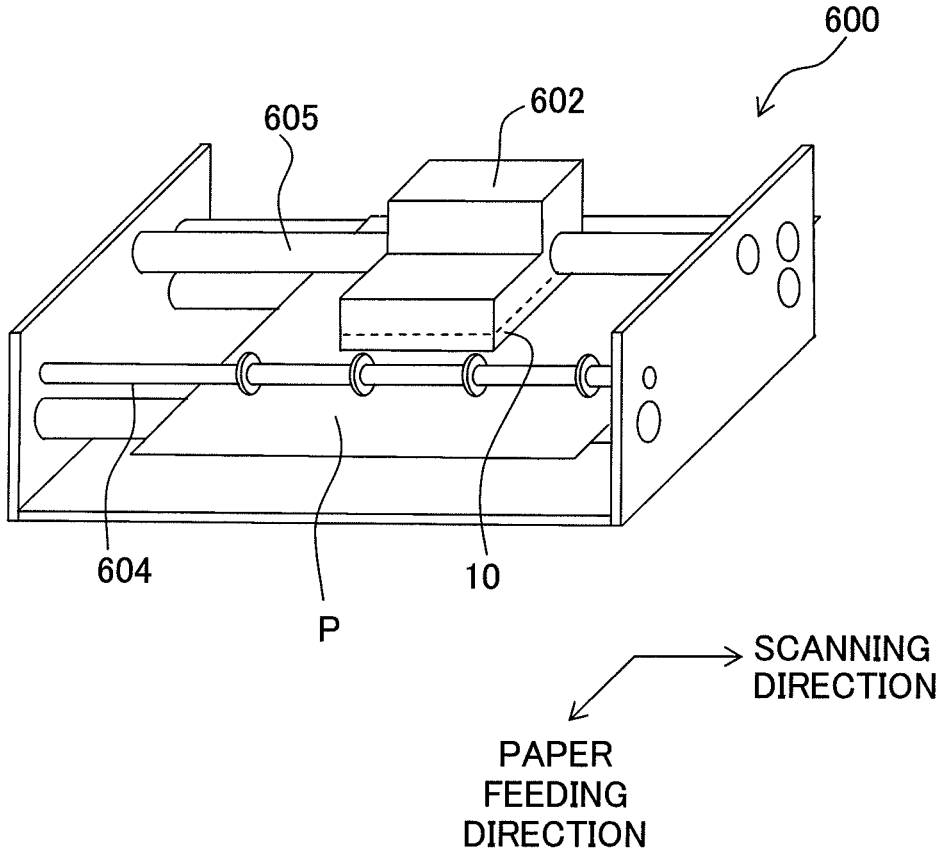
FIG. 15 is a schematic view of an ink-jet printer.

As shown in FIG. 1, an ink-jet apparatus 10 is an apparatus which selectively jets inks of four colors namely, black (BK), yellow (Y), cyan (C), and magenta (M) toward an object (not shown in the diagram) such as a paper, from a plurality of nozzles (FIG. 2), according to a driving pulse which has been output from two driver ICs 12, and includes an ink jet head 16 as a 'liquid jetting head' and a circuit board 18. As shown in FIG. 15, the ink jet apparatus 10 is mounted on an ink-jet printer (image forming apparatus) 600. In this case, the ink jet printer 600 includes a carriage 602 which is configured to reciprocate along a guide shaft 605, the ink-jet apparatus 10 which is mounted on the carriage 602, and a transporting mechanism 604 which transports a recording paper P in a transporting direction which is orthogonal to a direction in which the guide shaft 605 is extended (scanning direction of the carriage 602).

Figure 2:
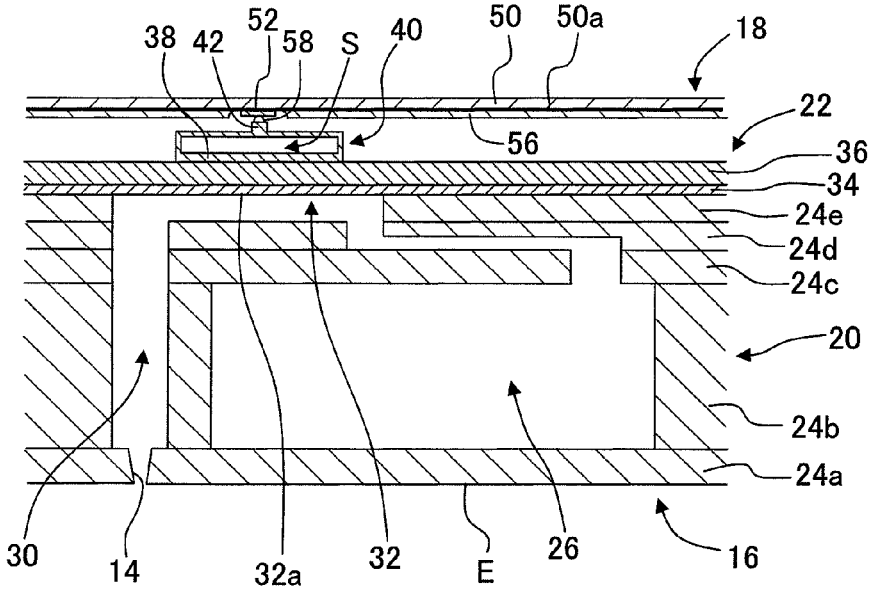
FIG. 2 is a partial cross-sectional view showing the structure of the 'ink-jet apparatus' according to the first embodiment.

As shown in FIG. 2, the ink-jet head 16 includes a channel unit 20 and an actuator unit 22. The channel unit 20 has five plates 24*a*, 24*b*, 24*c*, 24*d*, and 24*e* which are stacked mutually. The 'recesses' or 'through holes' are formed, in the four plates 24*a* to 24*e*, to be communicated with each other. Therefore, four ink channels N1, N2, N3, and N4 (FIG. 1) are formed corresponding to inks of four colors. Each of the ink channels N1 to N4, as shown in FIG. 2, includes a manifold 26 which stores ink, an ink supply port 28 (FIG. 1) through which the ink is supplied to the manifold 26, the plurality of nozzles 14 through which the ink in the manifold 26 is jetted, and a plurality of individual channels 30 through which the manifold 26 and the plurality of nozzles 14 communicate. Each of the individual channel 30 is provided with a pressure chamber 32 which communicates individually with one of the nozzles 14.

Figure 3:
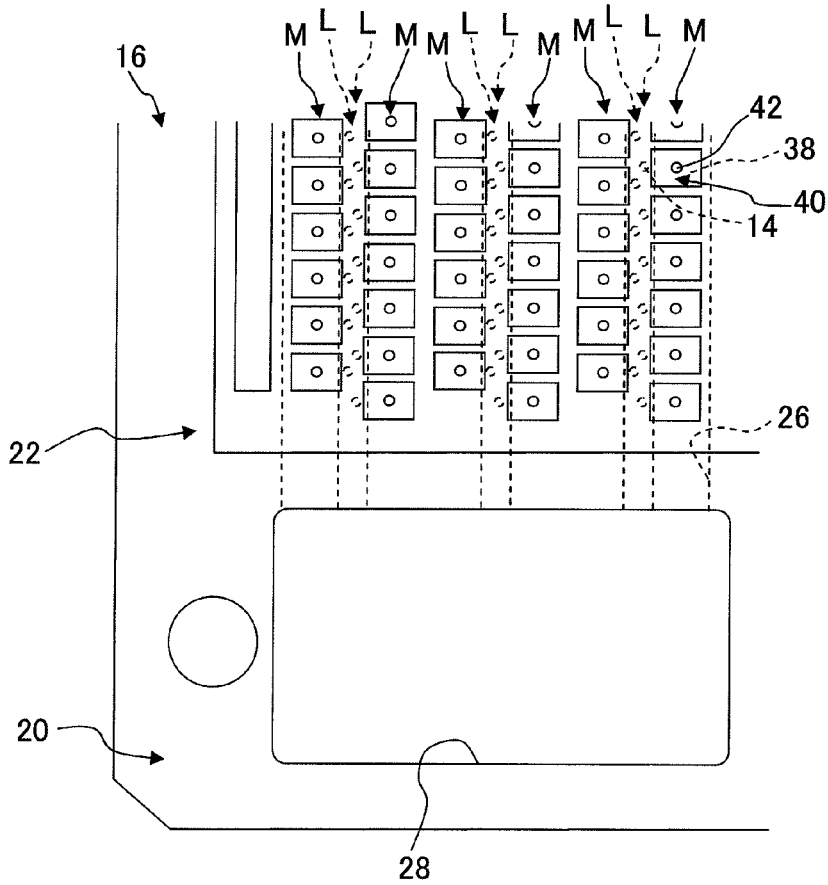
FIG. 3 is a partially enlarged plan view showing a structure of an 'ink-jet head' in the 'ink-jet apparatus' according to the first embodiment.

Moreover, as shown in FIG. 3, a plurality of nozzle rows L which are extended in an extending direction of the manifold 26 is formed corresponding to the ink channels N1 to N4 (FIG. 1), in a nozzle surface E (FIG. 2) in the ink-jet head 16 in which the plurality of nozzles 14 open. The nozzle rows L are lined up in an orthogonal direction orthogonal to the extending direction of the manifold 26. The plurality of nozzle rows L corresponding to the ink channels N1 to N4 have almost same length, and are arranged mutually parallel in the nozzle surface E.

On the other hand, the actuator unit 22, as shown in FIG. 2, is a unit which defines an upper surface of the pressure chamber 32 of the channel unit 20, and selectively applies a jetting pressure to the ink in each of the pressure chambers 32. The actuator unit 22 includes a vibration plate 34, a piezoelectric layer 36, a plurality of electrodes 38, a plurality of lead portions 40, and a plurality of input terminals 42.

The vibration plate 34, as shown in FIG. 2, is formed of an electroconductive material such as stainless steel, and is joined to an upper surface of the channel unit 20 to cover the plurality of pressure chambers 32. The piezoelectric layer 36 is formed of a piezoelectric material which is principally formed of lead zirconate titanate (PZT), and is polarized in a thickness direction thereof.

Each of the electrodes 38, as shown in FIG. 2, is formed of an electroconductive material such as AgPb and Au, and is arranged, corresponding to the plurality of nozzles 14, on a surface of the actuator unit 22, at a position facing the pressure chamber 32. Moreover, as shown in FIG. 3, each of the electrodes 38 is formed to be substantially rectangular-shaped such that a length thereof in the extending direction of the nozzle row L is shorter than a length thereof in an orthogonal direction orthogonal to the extending direction of the nozzle row L. An electrode row M of the plurality of electrodes 38 corresponding to a certain nozzle row L and another electrode row M of the plurality of electrodes corresponding to another nozzle row L have almost the same length and are arranged to be mutually parallel.

Figure 4:
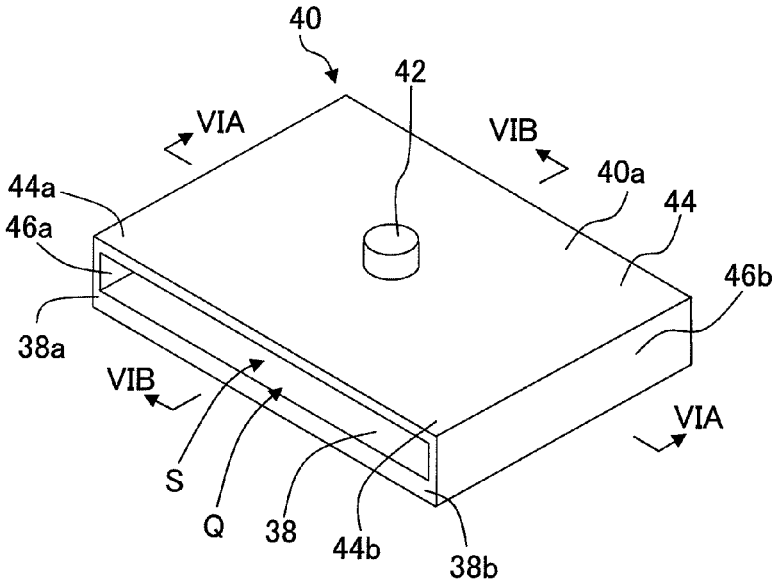
FIG. 4 is a perspective view showing a structure of the lead portion according to the first embodiment.
Figure 6A:
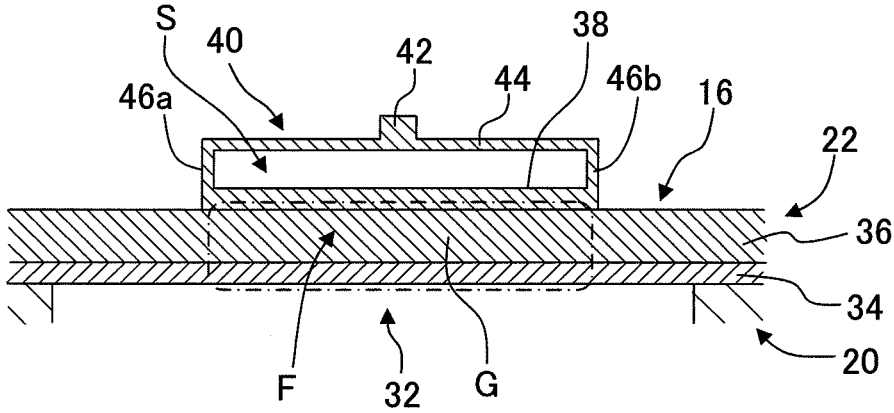
FIG. 6A is a cross-sectional view taken along a line VIA-VIA in FIG. 4.
Figure 6B:
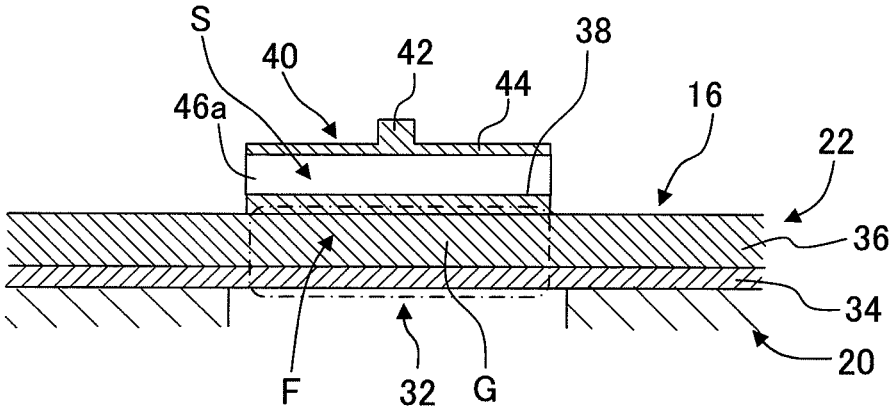
FIG. 6B is a cross-sectional view taken along a line VIB-VIB in FIG. 4.

Each of the lead portions 40, as shown in FIGS. 4, 6A and 6B, is a member which is bridged between two locations in the peripheral portion of the electrodes 38, while maintaining a space S between the electrode 38 and the lead portion 40, and the lead portion 40 is formed of an electroconductive material such as Cu. In other words, the lead portion 40 has a terminal forming portion 44 in the form of a flat plate facing the electrode 38, having a substantially rectangular shape almost same as the electrode 38 in a plan view, a first leg portion 46*a* which electrically and physically connects the one end-edge 38*a* of the electrode 38 and one end-edge 44*a* of the terminal forming portion 44 facing the one end-edge 38*a*, and a second leg portion 46*b* which electrically and physically connects the other end-edge 38*b* of the electrode 38 and the other end-edge 44*b* of the terminal forming portion 44 facing the other end-edge 38*b*. The terminal forming portion 44 is supported by the first leg portion 46*a* and the second leg portion 46*b*. Therefore, the space S is secured between the electrode 38 and the terminal forming portion 44.

Moreover, the input terminal 42 in the form of a protrusion (projection) is formed integrally at a central portion of a surface 40*a* of the lead portion 40, on an opposite side of the electrode 38. The input terminal 42 and the electrode 38 are connected electrically via the lead portion 40.

A shape of the input terminal 42 is not necessarily restricted to a circular cylindrical shape shown in FIG. 4, and may be a polygonal columnar shape and a truncated cone shape. Moreover, in a case of providing a terminal in the form of a protrusion (projection) (not shown in the diagram) on the input terminal 42, the input terminal 42 is not necessarily required to be in the form of a protrusion, and a portion of a surface of the lead 40 may be used as it is as the input terminal 42. Moreover, the number of the input terminals 42 and positions at which the input terminals 42 are to be arranged may also be changed arbitrarily according to the requirement. For example, the input terminal 42 may not be necessarily formed at a substantially central portion of the terminal forming portion 44 of the lead portion 40, and may be arranged near any one of the first leg portion 46*a* and the second leg portion 46*b*. Moreover, a single input terminal 42 may not be necessarily formed for each of the lead portions 40, and for instance, two or more input terminals 42 may be formed on the terminal forming portion 44. In this case, since each of the electrodes 38 is electrically connected via the plurality of input terminals 42 to one of the connecting terminal 52 of the circuit board 18, which will be described later, it is possible to improve reliability of an electrical connection between the connecting terminal 52 and the electrode 38. Moreover, a direction in which the lead portion 40 is bridged is not restricted in particular, and may be a 'short-direction (or width direction)' of the electrode 38. However, for inhibiting a deformation of a drive portion F from being hindered by the lead portion 40, it is desirable that the direction in which the lead portion 40 is bridged is a 'longitudinal direction' of the electrode 38.

Figure 5A:
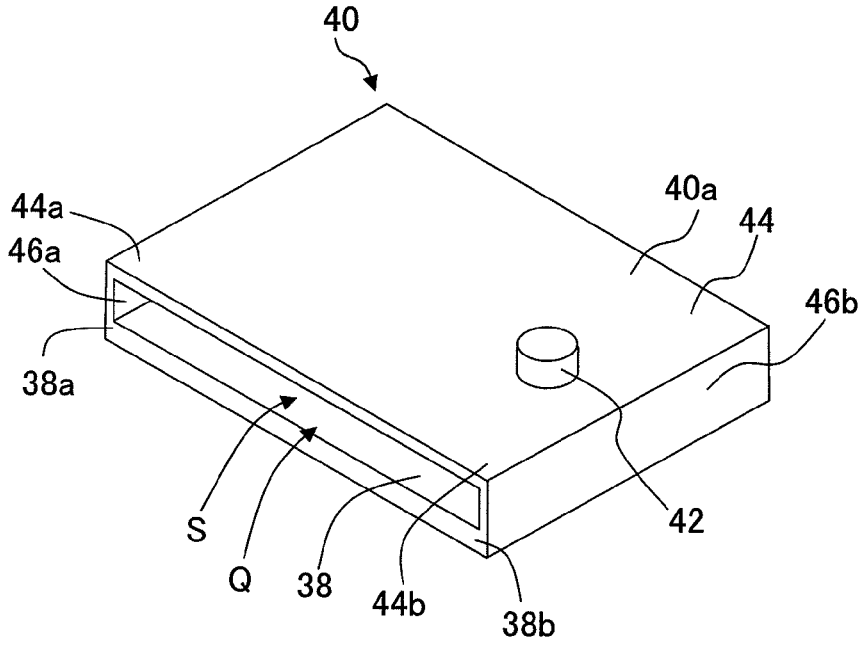
FIG. 5A shows an example of the lead portion having a shifted input terminal.
Figure 5B:
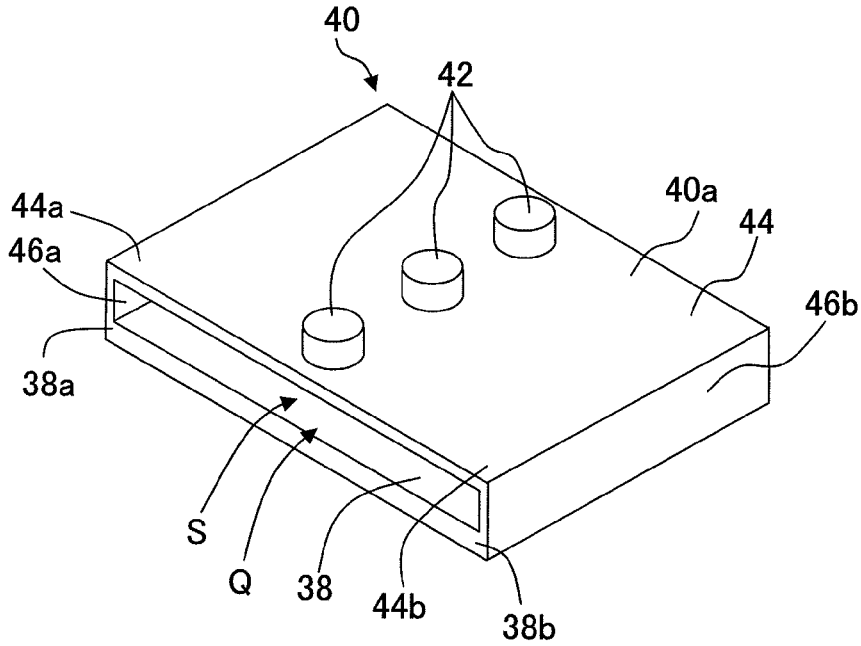
FIG. 5B shows another example of the lead portion having a plurality of input terminals.

When the actuator unit 22 is driven, the vibration plate 34 is kept at a ground electric potential (0 V) as well as a driving pulse is applied to the electrode 38 via the input terminal 42. At this time, a portion (an active portion G) of the piezoelectric layer 36 sandwiched between the vibration plate 34 and the electrode 38 (FIG. 5) is deformed by a piezoelectric effect according to the driving pulse. In the actuator unit 22, as shown in FIG. 5, the electrode 38, a portion of the vibration plate 34 facing the electrode 38, and the active portion G form a 'drive portion F' which is deformed when the driving pulse is applied to the electrode 38. In other words, a structure of the actuator unit 22 according to the first embodiment is a 'unimorph structure' in which the drive portion F is displaced alternately toward both sides in a thickness direction of the actuator unit 22, and not only a defining portion of the vibration plate 34 defining an upper surface 32*a* of the pressure chamber 32 but also the electrode 38 facing the defining portion of the vibration plate 34 is also included in the drive portion F.

Figure 7:
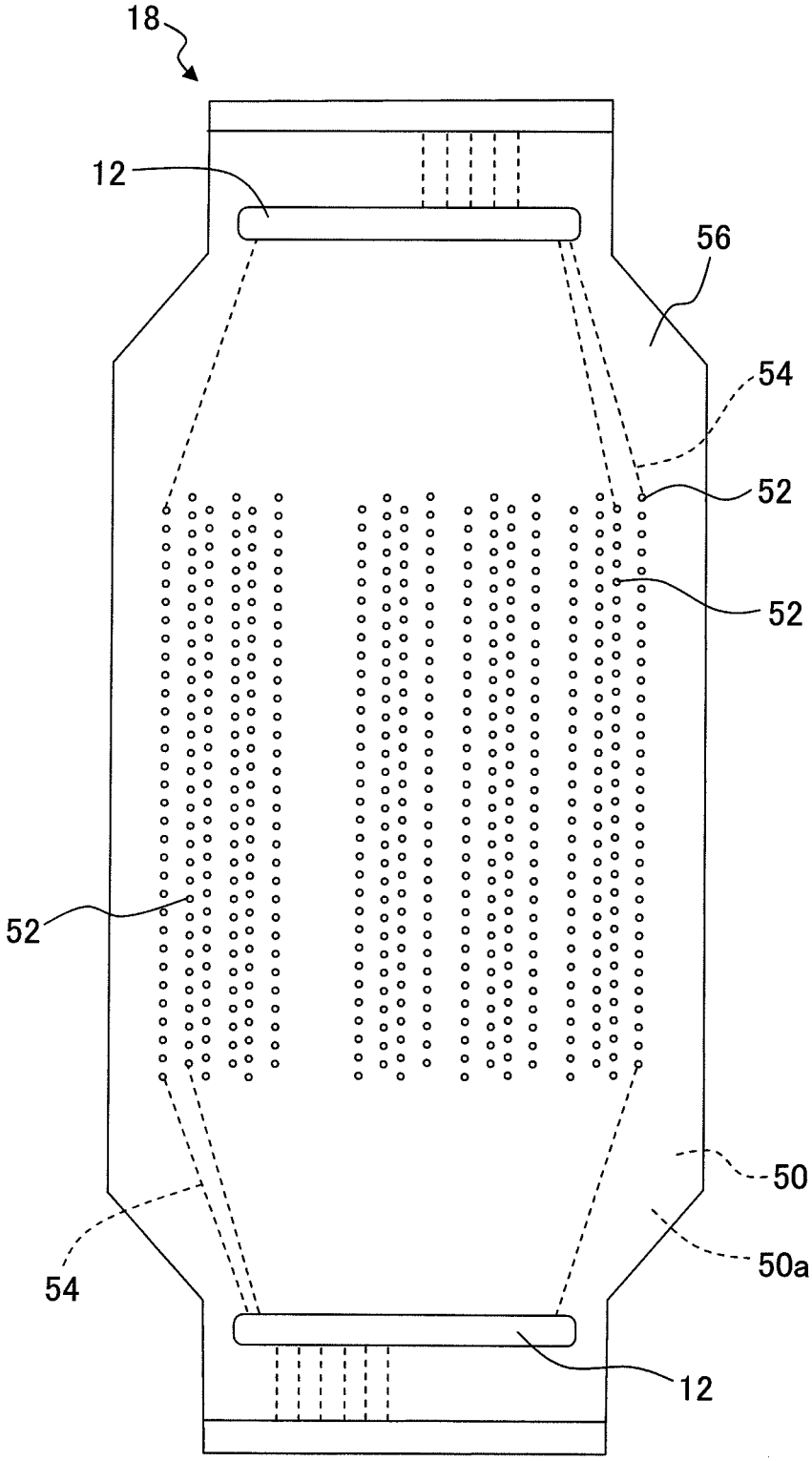
FIG. 7 is a base view showing a structure of 'the circuit board' in the 'ink-jet apparatus' according to the first embodiment.

As shown in FIGS. 2 and 7, the circuit board 18 is a so-called 'chip-on-film (COF)' and includes a substrate 50, two driver ICs 12 (FIG. 7), the plurality of connecting terminals 52, a plurality of wires 54 (FIG. 7), and an insulation coating material 56. The substrate 50 (FIGS. 2 and 7) is a member in the form of a sheet of a synthetic resin material having flexibility such as polyimide (PI) which is arranged to face a surface of the ink-jet head 16 on which the electrodes 38 are formed, and two driver ICs 12 for outputting the driving pulse are mounted on a surface, of the substrate 50, which faces the ink jet head 16 (head facing surface 50*a*). Moreover, the plurality of connecting terminals 52 made of an electroconductive material such as copper foil, the plurality of wires 54 which electrically connect the plurality of connecting terminals 52 and one of the two driver ICs 12, and the insulation coating material 56 which covers the plurality of connecting terminals 52 and the plurality of wires 54 are formed on the head facing surface 50*a*. As shown in FIG. 2, the plurality of input terminals 42 of the ink jet head 16 and the plurality of connecting terminals 52 of the circuit board 18 are joined electrically and physically by using an electroconductive joining material 58 such as solder and an electroconductive adhesive.

Figure 8A:
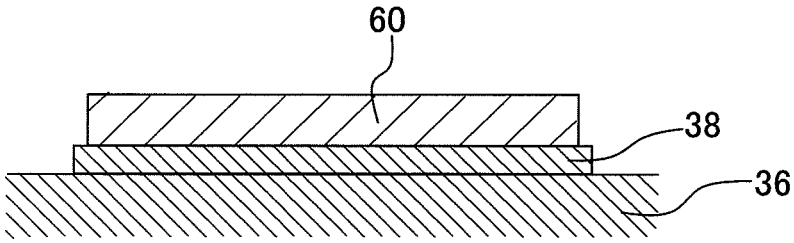
FIG. 8A to FIG. 8E are process diagrams showing a method of manufacturing the 'ink-jet apparatus' according to the first embodiment.
Figure 8B:
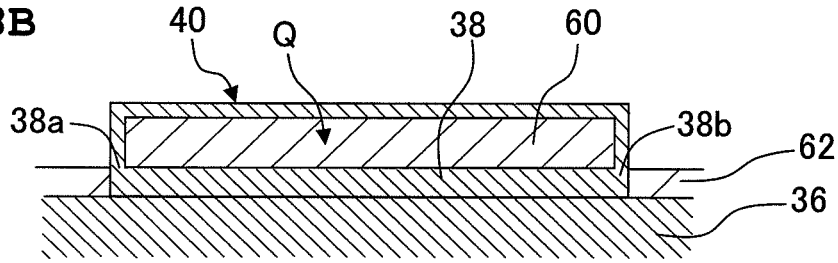
Figure 8C:
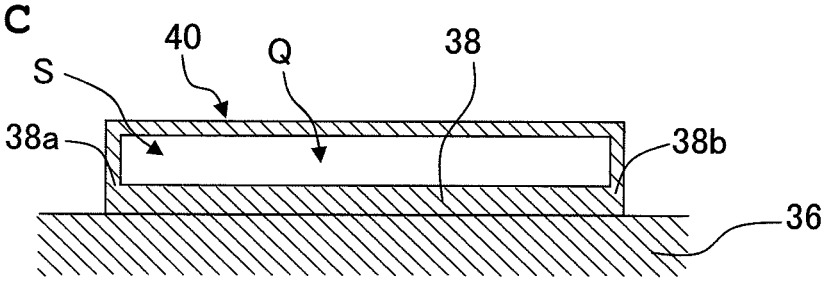

At the time of manufacturing the ink-jet apparatus 10, firstly, the ink-jet head 16 described above and the circuit board 18 are prepared. Thereafter, the plurality of connecting terminals 52 of the circuit board 18 and the plurality of input terminals 42 of the ink-jet head 16 are joined electrically and physically by the electroconductive joining material 58 as described above. In a preparation process of the ink jet head 16, at the time of forming the electrodes 38, the lead portion 40, and the input terminals 42 on the surface of the actuator unit 22, firstly, as shown in FIG. 8A, the electrodes 38 are formed simultaneously on the surface of the piezoelectric layer 36 by a method such as a vapor deposition method, and a sacrifice layer 60 which is to be removed after the process is formed on an upper surface of the electrode 38. Next, as shown in FIG. 8B, a portion, of the electrode 38, other than both end-edges 38*a* and 38*b* and the sacrifice layer 60 is covered by a mask member 62, and the lead portion 40 which is in continuity with the both end edges of the electrode 38 are formed on a surface of the sacrifice layer 60 by a method such as the vapor deposition method. Further, as shown in FIG. 7, the sacrifice layer 60 and the mask member 62 are removed by a method such as a dry etching method.

In the first embodiment, as shown in FIG. 4, the lead portion 40 is spanned or bridged in a the form of a bridge between the one end-edge 38*a* and the other end-edge 38*b* in the longitudinal direction (a direction orthogonal to the extending direction of the nozzle row L) of the electrode 38. Therefore, in the extending direction of the nozzle row L (a short-direction or width direction of the electrode 38), an area, which is to be the space S, is opened to outside via an opening portion Q. Consequently, at the time of removing the sacrifice layer 60, it is possible to infuse an etching gas through the opening portion Q into the area where the sacrifice layer 60 is positioned (in other words, an area which is to be the space S), and it is possible to remove the sacrifice layer 60 promptly.

Figure 8D:
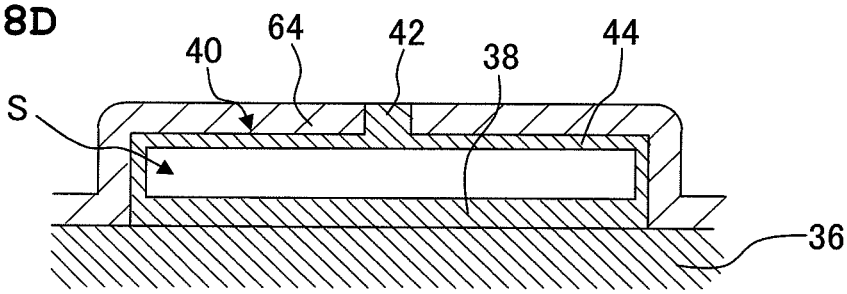
Figure 8E:
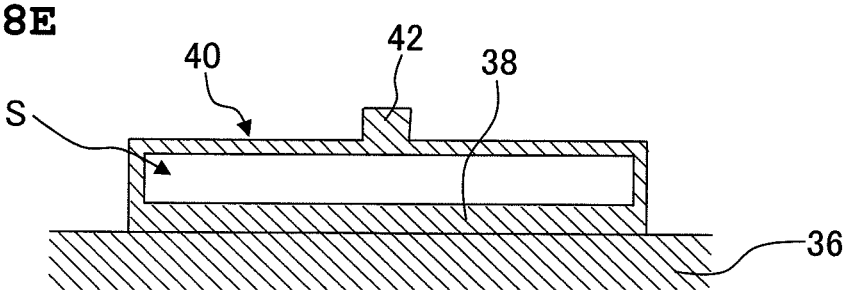

When the lead portion 40 is completed, as shown in FIG. 8D, a portion, of the lead portion 40, other than a central portion of the terminal forming portion 44 is covered by a mask member 64, and the input terminal 42 in continuity with the central portion of the terminal forming portion 44 is formed by a method such as the vapor deposition method. Thereafter, as shown in FIG. 8E, the mask member 64 is removed by a method such as the dry etching method.

According to the first embodiment, since the lead portion 40 is bridged, while securing the space S, between the electrode 38 and the lead portion 40, it is possible to prevent the lead portion 40, the input terminal 42, and the circuit board 18 from making a contact with a central portion of the electrode 38. Moreover, since the lead portion 40 is bridged between the two locations of the edge portion of the electrode 38, and the input terminal 42 is formed integrally with respect to the lead portion 40, it is possible to arrange the input terminal 42 at a position facing the electrode 38, and as compared to a case in which the electrode 38 and the input terminal 42 are arranged on the same surface, it is possible to arrange the plurality of electrodes 38 highly densely.

Moreover, the input terminal 42 is formed on the lead portion 40 in the form of a bridge. Therefore, even when the electroconductive joining material 58 made of a silver alloy is adhered to the input terminal 42, it is possible to prevent the electroconductive joining material 58, which has stuck out from the input terminal 42, from being adhered to a portion surrounding the electrode 38 on the piezoelectric layer 36. In a case of using an electroconductive adhesive as the electroconductive joining material 58, at the time of joining the connecting terminal 52 of the circuit board 18 and the input terminal 42, it is not necessary to press the circuit board 18 strongly toward the input terminal 42. Therefore, even at the time of joining the connecting terminal 52 of the circuit board 18 and the input terminal 42, there is no fear that the lead portion 40 is damaged due to an excessive suppressing strength.

Figure 9:
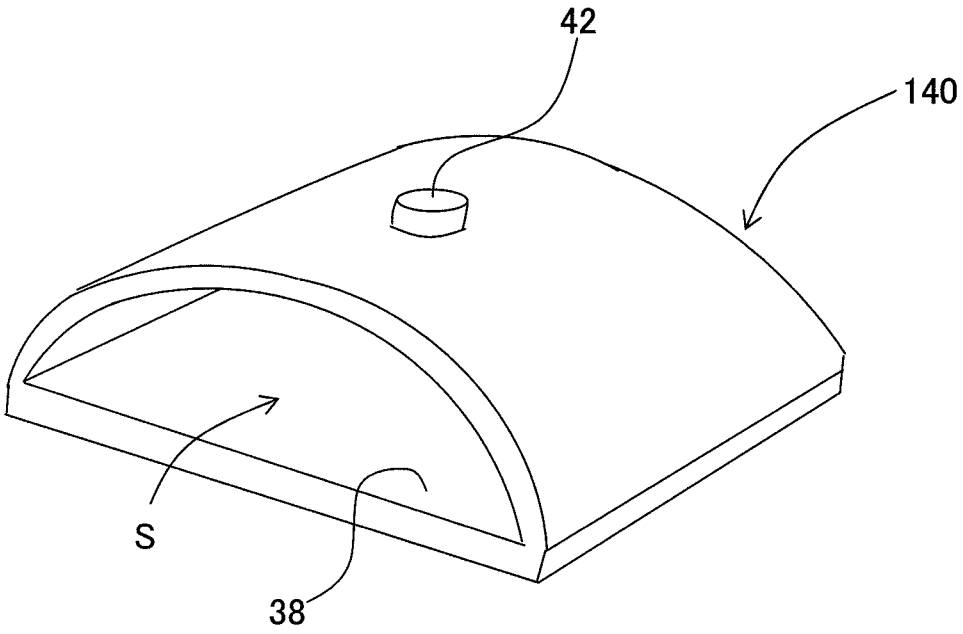
FIG. 9 is a schematic view showing a lead portion having an arch shape.

Regarding the deformation of the electrode 38, since the central portion of the electrode 38 is deformed most substantially with the deformation of the drive portion F, a degree of deformation of an edge portion in the 'short-direction' of the electrode 38 becomes greater than a degree of deformation of the edge portion in the 'longitudinal direction' of the electrode 38. In the first embodiment, since the lead portion 40 is bridged between the one end-edges 38*a* and the other end-edge 38*b* in the longitudinal direction of the electrode 38, for which the degree of deformation is comparatively smaller among the edge portions of the electrode 38, it is possible to inhibit efficiently the deformation of the drive portion F from being hindered by the lead portion 40. In the lead portion 40, the terminal forming portion 44, and the first leg portion 46*a* and the second leg portion 46*b* are arranged to be substantially orthogonal. However, the present teachings are not restricted to such arrangement, and as long as the space S is formed between the lead portion 40 and the electrode 38, the shape of the lead portion 40 may be arbitrary. For instance, as shown in FIG. 9, the lead portion 40 may be formed to be substantially arch-shaped. Such arch shape is structurally stronger as compared to a substantial box shape such as the lead portion 40, and has a peculiarity of being stronger with respect to a force pushing the lead portion 40 from an obliquely upward direction in particular.

Second Embodiment

Figure 10A:
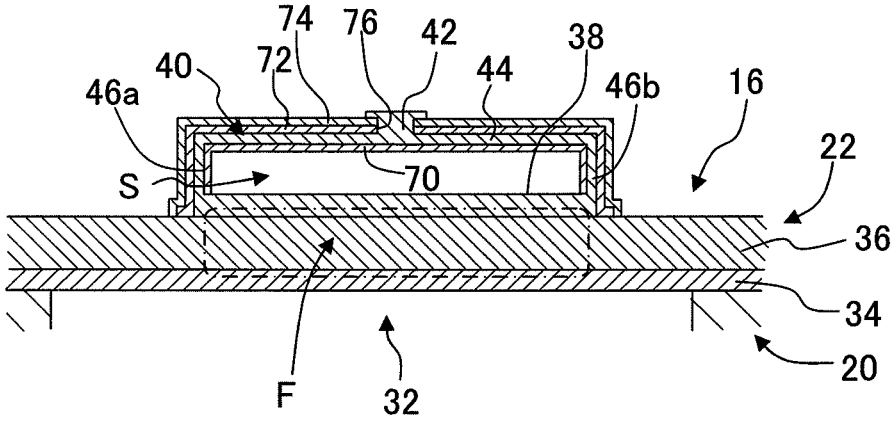
FIG. 10A and FIG. 10B are cross-sectional views showing a structure of an 'ink-jet head' in an 'ink-jet apparatus' according to a second embodiment, where.
Figure 10B:
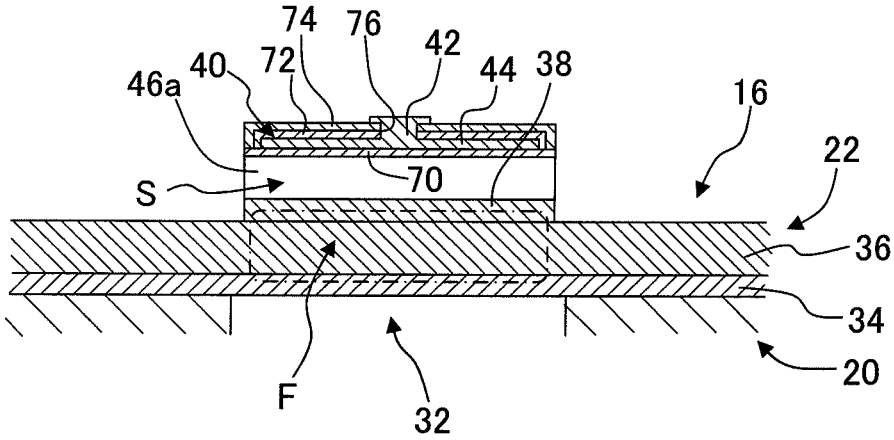

In a liquid discharge apparatus according to a second embodiment, a first protective layer 70, a second protective layer 72, and a third protective layer 74 are formed as shown in FIGS. 10A and 10B, corresponding to the lead portion 40 in the ink-jet apparatus 10 according to the first embodiment, and the rest of the structure is similar as in the ink-jet apparatus 10. In other words, the first protective layer 70 made of an oxide film formed of an SiO2 thin film or ethyl silicate (TEOS) is formed on a surface, of the lead portion 40, facing the electrode 38, the second protective layer 72 made of polyimide (PI) is formed on a surface, of the lead portion 40, not facing the electrode 38, and the third protective layer 74 made of silicon nitride (SiN) is formed on a surface of the second protective layer 72. The first protective layer 70, the second protective layer 72, and the third protective layer 74 may be formed by a method such as the vapor deposition method. Moreover, a through hole 76 which is cut through the input terminal 42 is formed in the second protective layer 72 and the third protective layer 74 that are formed on the surface of the lead portion 40, on the opposite side of the electrode 38. The input terminal 42 is inserted through the through hole 76 and is protruded on an opposite side of the electrode 38, of the second protective layer 72 and the third protective layer 74.

According to the second embodiment, since it is possible to cut off moisture etc. by the first protective layer 70, the second protective layer 72, and the third protective layer 74, it contributes to prevent corrosion of the lead portion 40. Here, the first protective layer 70 is capable of cutting off the moisture which would have passed through from a lower side (from the space S) of the lead portion 40. The second protective layer 72 and the third protective layer 74 are capable of cutting off the moisture which would have passed through from an upper side of the lead portion 40. The second protective layer 72 and the third protective layer 74, even when used independently, are capable of cutting off the moisture. However, by using the second protective layer 72 and the third protective layer 74 as in the second embodiment, it is possible to cut off the moisture effectively. Moreover, since silicon nitride which is used as the third protective layer 74 is extremely hard, it is possible to prevent a portion located at an under layer of the third protective layer 74 from being scratched. Therefore, it is possible to prevent physical damage of the lead portion 40 by the third protective layer 74. Particularly, for preventing any physical damaged being imparted to the lead portion 40 by an external factor, it is preferable to form the third protective layer 74 at the outermost side as in the second embodiment. Materials of the first protective layer 70, the second protective layer 72, and the third protective layer 74 may be changed arbitrarily according to an object. For instance, the first protective layer 70 is not necessarily required to be an oxide film, and may be formed of other insulating material. Moreover, one or two of the first protective layer 70, the second protective layer 72, and the third protective layer 74 may be omitted, or a fourth protective layer (not shown in the diagram) may be formed in addition to the first, second and third protective layers.

Third Embodiment

Figure 11:
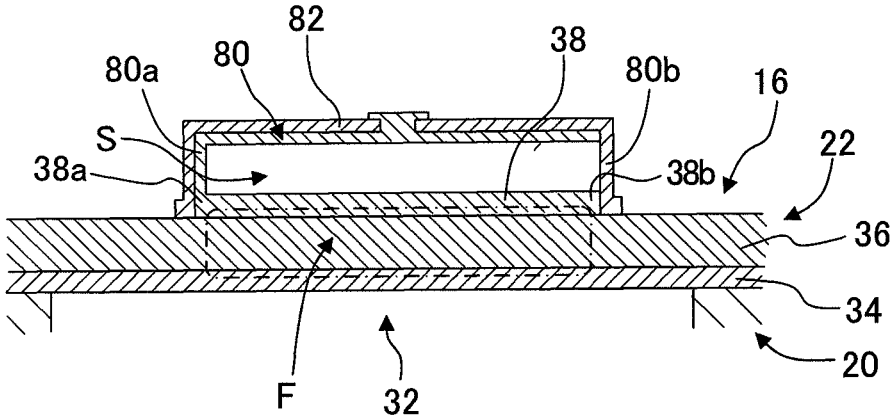
FIG. 11 is a cross-sectional view showing a structure of an 'ink-jet head' in an 'ink-jet apparatus' according to a third embodiment.

In the first embodiment, the entire lead portion has been formed of an electroconductive material. However, the present teachings are not restricted to such arrangement, and a part of the lead portion may be formed of an insulating material. An ink jet apparatus according to a third embodiment, as shown in FIG. 11, is an apparatus in which the lead portion 40 in the ink-jet apparatus 10 according to the first embodiment is changed to other lead portion 80, and also, a second protective layer 82 is formed on a surface, of the lead portion 80, on an opposite side of the electrode 38, and the rest of the structure is similar as in the ink-jet apparatus 10. The lead portion 80 includes an electroconductive portion 80*a* which is formed of an electroconductive material such as copper and which connects electrically the one end-edge 38*a* of the electrode 38 and the input terminal 42; and an insulating portion 80*b* which is formed of an insulating material such as SiN and SiO2 and which connects physically the other end-edge 38*b* of the electrode 38 and the electroconductive portion 80*a*. Moreover, the second protective layer 82 which is in continuity with the insulating portion 80*b* is formed on a surface, of the electroconductive portion 80*a*, on the opposite side of the electrode 38.

According to the third embodiment, since a part of the lead portion 80 is formed of an insulating material, it is possible to reduce an amount of the electroconductive material, thereby reducing a material cost. In such manner, a part of the lead portion 80 may be formed of an insulating material provided that, in the lead portion 80, the electroconductive material is arranged to bring at least the electrode 38 and the input terminal 42 into electrical conduction. Even in the third embodiment, a 'first protective layer' may be formed on a surface, of the lead portion 80, on a side of the electrode 38, or, a 'third protective electrode' may be formed on a surface of the second protective layer 82. Moreover, the lead portion 80 may be formed to be arch-shaped.

Fourth Embodiment

Figure 12:
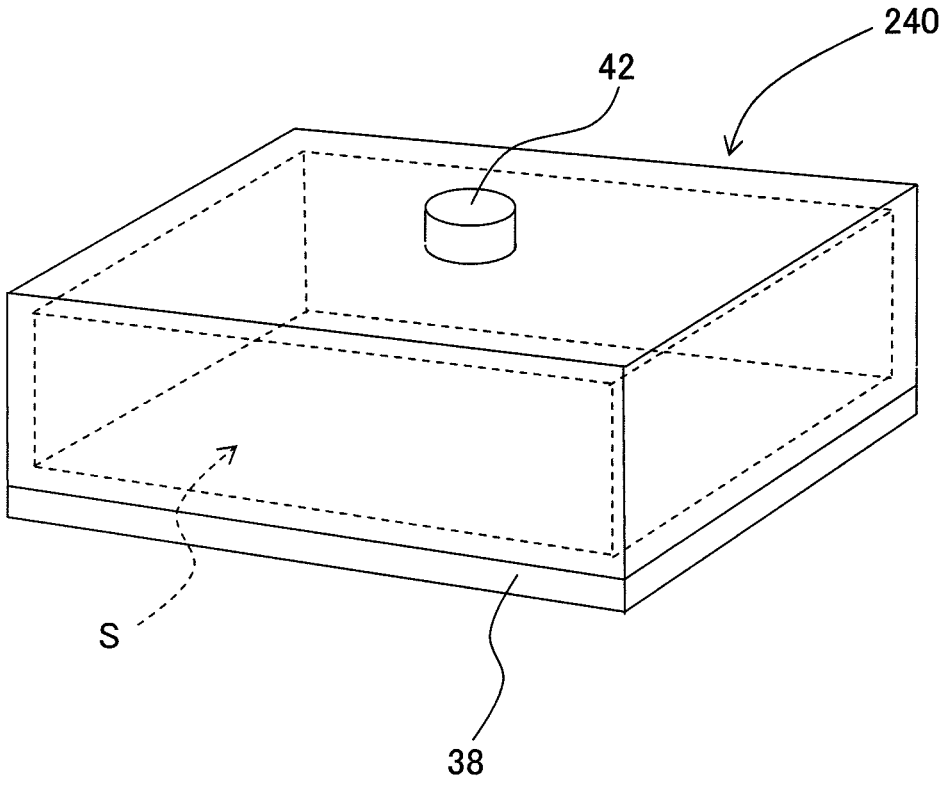
FIG. 12 is a schematic view showing a lead portion having a box shape.

In the first to third embodiments as described above, both of the lead portions 40 and 80 have been formed bridging the two end portions of the electrode 38 while forming the space S between the electrodes 38. In this case, for instance, when the lead portion 40 (80) is formed to bridge the one end-edge 38*a* and the other end-edge 38*b* in the longitudinal direction of the electrode 38, the space S is covered by the lead portion 40 (80) when viewed from the longitudinal direction, but the space S is exposed to outside when viewed from the short-direction of the electrode 38. However, the present teachings are not restricted to the bridge-shaped lead portion as shown in the above embodiments. For example, a lead portion 240 may have a box shape covering the electrode 38 from four sides as shown in FIG. 12. Even in such case, the space S is formed between the lead portion 240 and the electrode 38. However, since the space S is covered entirely by the lead portion 240, the space S is not exposed to outside. In other words, since the electrode 38 is covered by the lead portion 240 from four sides and is not exposed to outside, it is possible to protect the electrode 38 effectively by the lead portion 240.

A method for forming the lead portion 240 which covers the electrode 38 from four sides will be described below while referring to diagrams from FIGS. 13A to 13E. Since FIGS. 13A to 13E correspond to FIGS. 8A to 8E, respectively, the repeated description will be omitted, and the points of difference will be described.

Figure 13A:
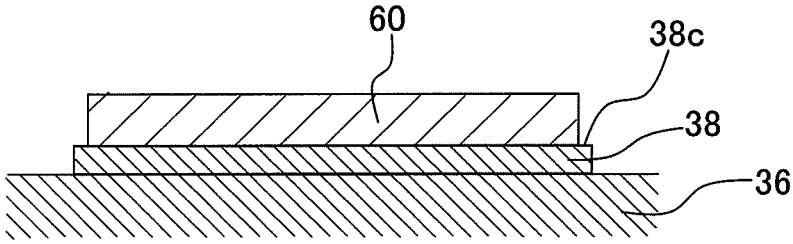
FIG. 13A to FIG. 13E are process diagrams showing manufacturing steps of an 'ink-jet apparatus' according to a fourth embodiment.
Figure 13B:
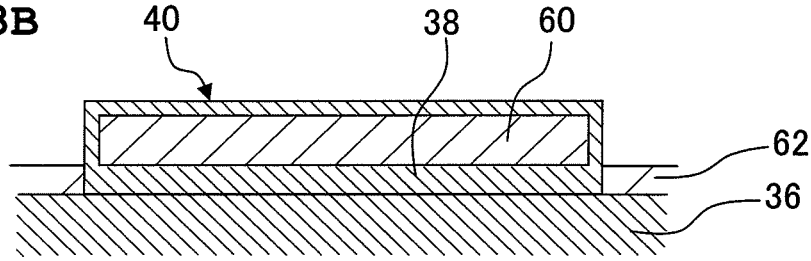
Figure 13C:
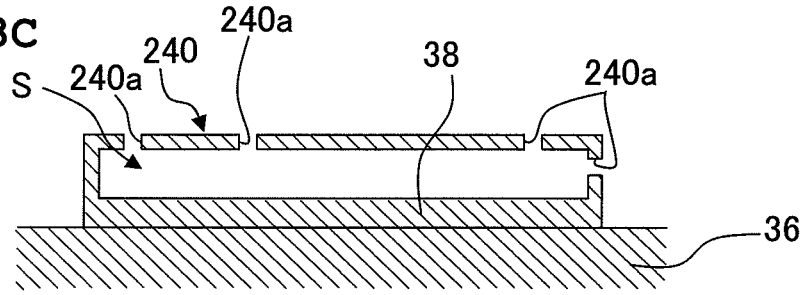

As shown in FIG. 13A, the plurality of electrodes 38 is formed on the surface of the piezoelectric layer 36 by a method such as the vapor deposition method, and the sacrifice layer 60 slightly smaller than the electrode 38 is formed on the upper surface of the electrode 38. In this case, since the sacrifice layer 60 is slightly smaller than the electrode 38 in a plan view, an area (an outer peripheral area 38*c*) in which the sacrifice layer 60 is not formed at an outer peripheral portion of the electrode 38 is formed. Next, as shown in FIG. 13B, a portion, of the electrode 38, other than the outer peripheral portion 38*c* and the sacrifice layer 60 are covered by the mask member 62, and the lead portion 240 in continuity with the outer peripheral portion 38*c* of the electrode 38 is formed on a surface of the sacrifice layer 60, by a method such as the vapor deposition method. Next, as shown in FIG. 13C, one through hole or a plurality of through holes 240*a* is/are formed in the lead portion 240 by a method such as a laser radiation, the sacrifice layer 60 and the mask member 62 are removed by a method such as the dry etching method. In this case, since the through holes 240*a* are formed in order for letting an etching gas etc. reach the sacrifice layer 60, a diameter of the through holes 240*a* may be substantially small. Therefore, the through holes 240*a* may not necessarily have a diameter larger than required.

Figure 13D:
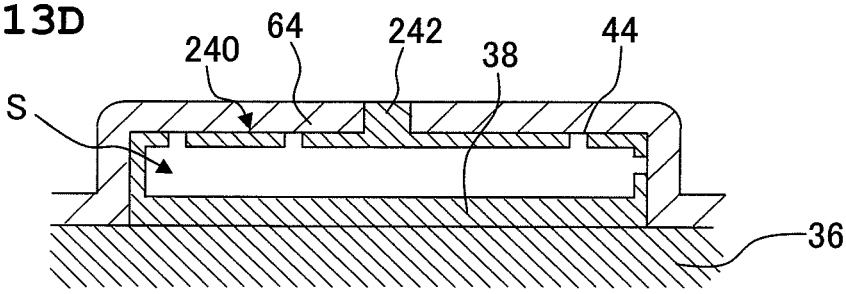
Figure 13E:
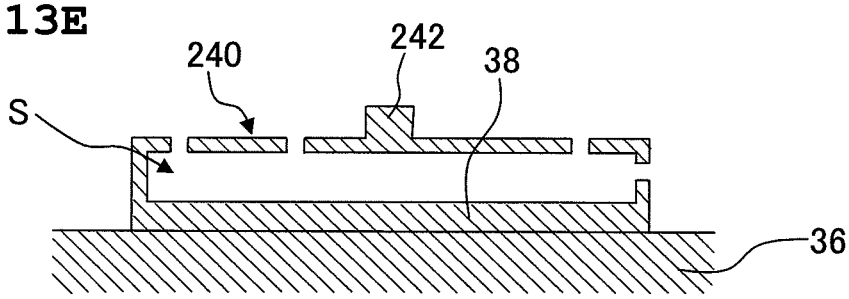

Next, as shown in FIG. 13D, a portion of the lead portion 240, other than a central portion of a terminal forming portion 244 is covered or coated by the mask member 64, and an input terminal 242 in continuity with the central portion of the terminal forming portion 244 is formed by a method such as the vapor deposition method. Thereafter, as shown in FIG. 13E, the mask member 64 is removed by a method such as the dry etching method.

According to the fourth embodiment, the space S is secured between the lead portion 240 and the electrode 38. Therefore, it is possible to obtain a technical effect similar to the technical effect obtained by the lead portion 40 of the first embodiment as described above. Concretely, since the space S is secured between the lead portion 240 and the electrode 38, it is possible to prevent the lead portion 240, the input terminal 242, and the circuit board 18 from making a contact with the central portion of the electrode 38, and to prevent an operation of the drive portion F from being hindered. Furthermore, since the lead portion 240 is covered from four sides by the electrode 38, it is possible to prevent effectively impurities such as dust and water droplets from adhering to the electrode 38.

Even in the fourth embodiment, a first protective layer, a second protective layer, and a third protective layer as shown in the second embodiment may be used for the lead portion 240. Or, a part of the lead portion 240 may be formed of an insulating material as shown in the third embodiment. Moreover, the lead portion 240 may not necessarily cover the entire electrode 38, and the lead portion 240 may cover the electrode 38 partially such that a part of the space S is exposed. Furthermore, the shape of the lead portion 240 is not restricted to the box shape, and may be changed arbitrarily. For instance, the lead portion 240 may be substantially semispherical dome shaped.

Here, when the lead portion 40 of the first embodiment and the lead portion 240 of the fourth embodiment are compared, from a viewpoint of protecting the electrode 38 from the impurities such as dust and water droplets, the lead portion 240 which covers the electrode 38 from four sides is more advantageous than the lead portion 40 having a shape of a bridge spanning over the electrodes 38. Whereas, the large opening portion Q is formed in the side surface of the lead portion 40. Therefore, in a case of removing the sacrifice layer 60 arranged at an interior of the lead portion 40 by etching gas etc., it is possible to remove the sacrifice layer 60 more efficiently as compared to the case of the lead portion 240. In such manner, in a case of forming the lead portion 40, since it is possible to infuse etching gas etc. efficiently through the opening portion Q in the side surface, even when the sacrifice layer 60 is made thin, it is possible to remove the sacrifice layer 60 effectively. Therefore, it is possible to form the thinner lead portion 40 as compared to the lead portion 240.

Fifth Embodiment

Figure 14:
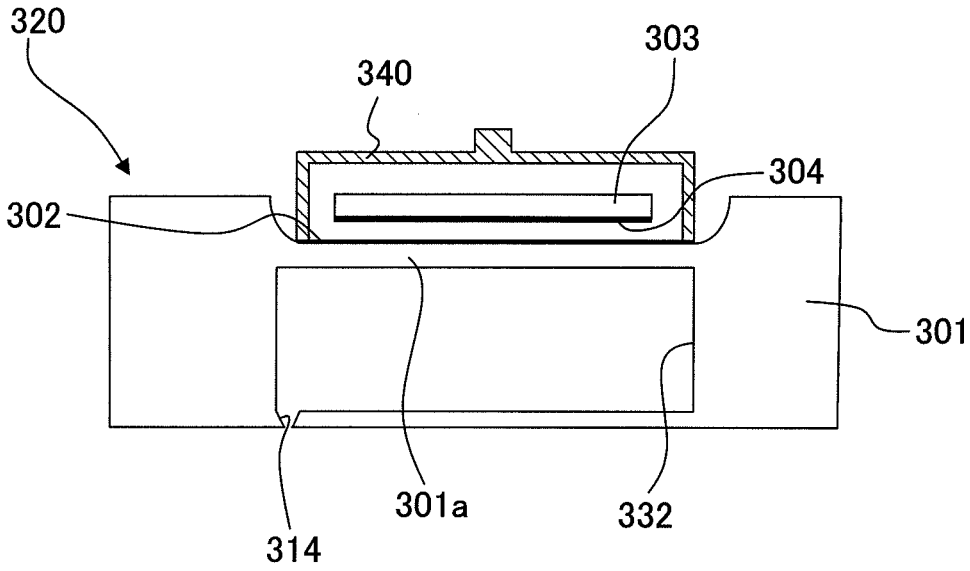
FIG. 14 is a schematic view showing a MEMS unit.

In the embodiments described above, the electrodes provided on the piezoelectric layer 36 are exemplified as the electrodes 38. However, the present teachings are not restricted to such arrangement. For instance, it may be an electrode provided to a three-dimensional movable structure formed on a semiconductor substrate, according to the so-called MEMS (Micro Electro Mechanical Systems). Such three-dimensional movable structure is realized by a micromechanical structure on a surface and/or at an interior of a semiconductor substrate such as a silicon substrate by applying a combining technology and a microfabrication technology of semiconductor. For example, as shown in FIG. 14, in a fifth embodiment, an MEMS unit 320 is used instead of the channel unit 20 and the actuator unit 22 of the first embodiment. The MEMS unit 320 corresponds to a channel unit and a drive section of the present teachings. The MEMS unit 320 includes mainly a semiconductor substrate 301 of silicon etc. in which a pressure chamber 332 and a nozzle 314 communicating with the pressure chamber 332 are formed, a first electrode 302 which is formed on an upper surface of the semiconductor substrate 301 in an area overlapping the pressure chamber 332, an electrode supporting portion 303 which is arranged leaving a space at an upper side of the first electrode 302, a second electrode 304 which is formed on a surface of the electrode supporting portion 303 facing the first electrode 302, and a lead portion 340 which covers the second electrode 304 (and the electrode supporting portion 303) while making an electrical contact with the second electrode 304. The area of the semiconductor substrate 301 on which the first electrode 302 is formed, is extremely thin, and forms a thin-wall portion 301*a*. Whereas, the electrode supporting portion 303 on which the second electrode 304 is formed is not as thin as the thin-wall portion 301*a*. In this case, for instance, when an electric potential of the second electrode 304 is switched to a positive and a negative electric potential while the electric potential of the first electrode 302 is kept at a negative electric potential, an electrostatic force is generated between the first electrode 302 and the second electrode 304 in accordance with the electric potential of the second electrode 304. It is possible to vibrate the thin-wall portion 301*a* which is formed to be extremely thin, in a vertical direction by the electrostatic force, and accordingly, it is possible to apply a jetting pressure to a liquid in the pressure chamber 332.

The electrostatic force acts on the second electrode 304 (and the electrode supporting portion 303). However, as described above, since the electrode supporting portion 303 is not as thin as the thin-wall portion 301, the electrode supporting portion 303 is not deformed as substantially as the thin-wall portion 301 is. The electrode supporting portion 303 also is a member which is extremely susceptible to breakage when an external force is exerted, and the first electrode 302 formed on the semiconductor substrate 301 is susceptible to be degraded due to moisture. Moreover, a gap between the first electrode 302 and the second electrode 304 is extremely small, and when impurities such as dust enter into the gap, a possibility that the deformation of the thin-wall portion 301*a* is hindered is high. However, in the fifth embodiment, since the second electrode 304 and the electrode supporting portion 303 are covered from four sides by the lead portion 340 while securing the space or gap between the second electrode 302 and the electrode supporting portion 303, it is possible to inhibit an external force from being exerted to the second electrode 302 and the electrode supporting portion 303, and to inhibit effectively the impurities from entering between the first electrode 302 and the second electrode 304. The lead portion 340 of the fifth embodiment is not restricted to be substantially box-shaped. For instance, the lead portion 340 may by bridge-shaped as the lead portion 40 of the first embodiment, or the lead portion 340 may be arch-shaped, or semispherical-shaped (dome-shaped). Moreover, the protective layers as described above may be formed on the lead portion 340 of the fifth embodiment.

In the above described embodiments, the vibration plate is formed of an electroconductive material to function as a common electrode. However, the present teachings are not restricted to such arrangement, and the vibration plate may be formed of an insulating material such as silicon and PZT. In this case, a common electrode may be formed on a surface of the vibration plate by an electroconductive material such as AgPb and Au. Moreover, even when the vibration plate is formed of an electroconductive material, the vibration plate may not be necessarily made to function as the common electrode, and an insulating layer may be formed on the surface of the vibration plate, and the common electrode may be formed on the insulating layer by an electroconductive material. Furthermore, the electrode 38 may not be necessarily formed on the uppermost layer of the actuator unit 22, and the piezoelectric layer 36 in addition may be formed on the upper surface of the electrode 38. In this case, a terminal may be formed on a portion corresponding to the electrode 38, on an upper surface of the piezoelectric layer 36 which is formed on the upper surface of the electrode 38, and a through hole in which an electroconductive material is filled may be formed in the uppermost piezoelectric layer 38, and by connecting the terminal and the electrode, a terminal which is in conduction with the electrode 38 may be drawn on the upper surface of the uppermost piezoelectric layer 36. Moreover, it is possible to form the lead portion 40 as described above to connect the terminal.

In the embodiments described above, a serial-type ink jet printer in which scanning is carried out by mounting the ink-jet apparatus on the carriage is exemplified. However, the present teachings are not restricted to such arrangement, and are also applicable to a so-called line-type ink jet printer. Moreover, while the present teachings are applied to an 'ink-jet apparatus' which jets an ink, the present teachings are also applicable to other 'liquid discharge apparatuses' such as a 'colored-liquid discharge apparatus' which jets a colored liquid other than ink, and an 'electroconductive liquid discharge apparatus' which jets an electroconductive liquid. When the present teachings are applied to the 'colored-liquid discharge apparatus' and the 'electroconductive-liquid discharge apparatus', the 'ink' used in the description made above is to be replaced by a 'colored liquid' and an 'electroconductive liquid'.

What is claimed is:

1. A liquid discharge apparatus which discharges a liquid, comprising:

a liquid discharge head including:

a channel unit formed with a plurality of nozzles through which the liquid is discharged and a plurality of liquid channels which communicate with the nozzles respectively;

a plurality of drive portions having a plurality of electrodes corresponding to the nozzles respectively and a deforming portion which is deformed to apply a jetting pressure to the liquid stored in the liquid channels according to a driving pulse applied to the electrodes;

a plurality of lead portions which correspond to the electrodes, which are connected electrically to the electrodes and which are arranged to cover the electrodes while maintaining a space between the electrodes and the lead portions; and a plurality of input terminals each of which is formed integrally on a surface, of one of the lead portions, not facing the electrodes and which are electrically connected to the electrodes via the lead portions; and a circuit board via which the driving pulse is applied to the liquid discharge head, and which has a plurality of connecting terminals electrically connected to the input terminals, respectively;

wherein each of the electrodes is arranged on a facing surface, of one of the driving portions, facing the circuit board, and wherein the lead portions have a bridge-shape, and each of the lead portions is bridged between two areas in an edge portion of one of the electrodes.

2. The liquid discharge apparatus according to claim 1;

wherein the nozzles form a nozzle row extending in an extending direction;

wherein a length of each of the electrodes in the extending direction is shorter than a length of the electrodes in an orthogonal direction orthogonal to the extending direction; and wherein each of the lead portions is bridged between one end-edge and the other end-edge of one of the electrode in the orthogonal direction.

3. The liquid discharge apparatus according to claim 1;

wherein a first protective layer is arranged on a surface, of each of the lead portions, facing one of the electrodes.

4. The liquid discharge apparatus according to claim 3;

wherein the first protective layer is formed of an oxide film.

5. The liquid discharge apparatus according to claim 1;

wherein a second protective layer is arranged on a surface, of each of the lead portions, not facing the one of the electrodes;

wherein a through hole, in which one of the input terminals is inserted, is formed in the second protective layer; and wherein each of the input terminals inserted in the through hole is protruded on a side of a surface, of the second protective layer, not facing the electrode.

6. The liquid discharge apparatus according to claim 5, further comprising:

a third protective layer which covers the second protective layer;

wherein the third protective layer is formed of silicon nitride.

7. The liquid discharge apparatus according to claim 6;

wherein the second protective layer is formed of a resin.

8. The liquid discharge apparatus according to claim 1;

wherein the input terminals are formed of a silver alloy.

9. The liquid discharge apparatus according to claim 1;

wherein the input terminal has a plurality of input terminals in each of the lead portions; and wherein the circuit board includes a plurality of land portions to be connected to and overlapped with the plurality of input terminals formed on each of the lead portions.

10. The liquid discharge apparatus according to claim 1.

wherein a third protective layer of silicon nitride is arranged, as an outermost layer, on the surface of each of the lead portions not facing one of the electrodes.

11. The liquid discharge apparatus according to claim 1;

wherein the deforming portions have a piezoelectric layer which covers the channel unit, and wherein the electrodes are arranged on a surface, of the piezoelectric layer, not facing the channel unit, and wherein a common electrode which is common for the drive portions is arranged on a surface, of the piezoelectric layer, on a side of the channel unit.

12. An image forming apparatus which discharges an ink as a liquid onto a medium to form an image on the medium, comprising:

the liquid discharge apparatus as defined in claim 1; and a transporting mechanism which transports the medium toward a position facing the liquid discharge apparatus.

13. A liquid discharge apparatus which discharges a liquid, comprising:

a liquid discharge head including:

a channel unit formed with a plurality of nozzles through which the liquid is discharged and a plurality of liquid channels which communicate with the nozzles respectively;

a plurality of drive portions having a plurality of electrodes corresponding to the nozzles respectively and a deforming portion which is deformed to apply a jetting pressure to the liquid stored in the liquid channels according to a driving pulse applied to the electrodes;

a plurality of lead portions which correspond to the electrodes, which are connected electrically to the electrodes and which are arranged to cover the electrodes while maintaining a space between the electrodes and the lead portions; and a plurality of input terminals each of which is formed integrally on a surface, of one of the lead portions, not facing the electrodes and which are electrically connected to the electrodes via the lead portions; and a circuit board via which the driving pulse is applied to the liquid discharge head, and which has a plurality of connecting terminals electrically connected to the input terminals, respectively;

wherein each of the lead portions stands on an entire edge portion of one of the electrodes, and covers the one of the electrodes entirely.

14. A liquid discharge apparatus which discharges a liquid, comprising:

a liquid discharge head including:

a channel unit formed with a plurality of nozzles through which the liquid is discharged and a plurality of liquid channels which communicate with the nozzles respectively;

a plurality of drive portions having a plurality of electrodes corresponding to the nozzles respectively and a deforming portion which is deformed to apply a jetting pressure to the liquid stored in the liquid channels according to a driving pulse applied to the electrodes;

a plurality of lead portions which correspond to the electrodes, which are connected electrically to the electrodes and which are arranged to cover the electrodes while maintaining a space between the electrodes and the lead portions; and a plurality of input terminals each of which is formed integrally on a surface, of one of the lead portions, not facing the electrodes and which are electrically connected to the electrodes via the lead portions; and a circuit board via which the driving pulse is applied to the liquid discharge head, and which has a plurality of connecting terminals electrically connected to the input terminals, respectively;

wherein each of the lead portions has a pair of leg portions standing on a facing surface, of one of the drive portions, facing the circuit board; and a terminal forming portion in the form of a plate bridging between the pair of leg portions, and wherein each of the input terminals is arranged on the terminal forming portion.

15. The liquid discharge apparatus according to claim 14;

wherein the input terminal is arranged in the vicinity of one of the pair of leg portions of the terminal forming portion.

* * * * *